US008974074B1

(12) United States Patent
Duchesneau et al.

(10) Patent No.: US 8,974,074 B1
(45) Date of Patent: Mar. 10, 2015

(54) MOUNTING SYSTEM FOR AIRFIELD GUARD LIGHT

(71) Applicants: Shawn Duchesneau, West Hartford, CT (US); Paul John Gongola, Enfield, CT (US); James David Doyle, Racine, WI (US)

(72) Inventors: Shawn Duchesneau, West Hartford, CT (US); Paul John Gongola, Enfield, CT (US); James David Doyle, Racine, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/046,690

(22) Filed: Oct. 4, 2013

(51) Int. Cl.
*F21L 4/00* (2006.01)
*F21V 15/00* (2006.01)

(52) U.S. Cl.
CPC ..... *F21V 15/00* (2013.01)
USPC ..... 362/183; 362/153

(58) Field of Classification Search
USPC ..... 362/376, 183, 177, 173, 186, 143
See application file for complete search history.

(56) References Cited

U.S. PATENT DOCUMENTS

| | | | | |
|---|---|---|---|---|
| 4,527,224 | A | 7/1985 | Sangiamo et al. | |
| 4,739,457 | A | 4/1988 | Orr | |
| D403,263 | S | 12/1998 | Giardini et al. | |
| D438,810 | S * | 3/2001 | Liao et al. | D10/115 |
| 7,134,764 | B1 * | 11/2006 | Bieberdorf | 362/183 |
| 8,021,026 | B2 | 9/2011 | Liu et al. | |
| 8,087,807 | B2 | 1/2012 | Liu et al. | |
| 8,104,933 | B2 | 1/2012 | Liu et al. | |
| 8,449,146 | B2 | 5/2013 | Chen | |
| 8,480,259 | B2 | 7/2013 | Nichols | |
| 8,534,622 | B2 | 9/2013 | Vanover | |
| 2010/0254148 | A1 | 10/2010 | Huang et al. | |
| 2011/0148661 | A1 * | 6/2011 | Shikii et al. | 340/907 |

* cited by examiner

*Primary Examiner* — Tracie Y Green
(74) *Attorney, Agent, or Firm* — King & Spalding LLP

(57) ABSTRACT

A mounting system for a light source. The mounting system can include a first portion having a light source coupling feature and a first vertical adjustment feature, where the first vertical adjustment feature includes first fastening features. The mounting system can also include a second portion mechanically coupled to the first portion, where the second portion includes a second vertical adjustment feature having second fastening features, where the second fastening features are mechanically coupled to the first fastening features. The mounting system can further include a horizontal adjustment feature disposed at a bottom end of the second portion and mechanically coupled to the second portion. The mounting system can also include a mounting feature mechanically coupled to the horizontal adjustment feature and configured to mechanically couple to a mounting device. The mounting system can further include a guarding device disposed on a top end of the second portion.

20 Claims, 5 Drawing Sheets

MOUNTING SYSTEM FOR AIRFIELD GUARD LIGHT

TECHNICAL FIELD

Embodiments described herein relate generally to a mounting system for a lighting fixture, and more particularly to systems, methods, and devices for a mounting system for an airfield guard light.

BACKGROUND

Airfield guard lights are generally elevated from ground level and are used to prevent runway incursions of planes entering from taxiways. An example airfield guard light includes a set of two flashing amber lights. The airfield guard light can be positioned at the taxiway/runway boundary, and the flashing lights warn the pilot of an aircraft not to proceed onto the runway.

SUMMARY

In general, in one aspect, the disclosure relates to a mounting system for a light source. The mounting system can include a first portion having a light source coupling feature and a first vertical adjustment feature, where the light source coupling feature is configured to mechanically couple to the light source, and where the first vertical adjustment feature comprises a first number of fastening features. The mounting system can also include a second portion mechanically coupled to the first portion, where the second portion comprises a second vertical adjustment feature having a second number of fastening features, where the second number of fastening features are mechanically coupled to the first number of fastening features. The mounting system can further include a horizontal adjustment feature disposed at a bottom end of the second portion and mechanically coupled to the second portion. The mounting system can also include a mounting feature mechanically coupled to the horizontal adjustment feature and configured to mechanically couple to a mounting device. The mounting system can further include a guarding device disposed on a top end of the second portion.

In another aspect, the disclosure can generally relate to an airfield guard light fixture. The airfield guard light fixture can include a light source and a mounting system mechanically coupled to the light source. The mounting system of the airfield guard light fixture can include a first portion having a light source coupling feature and a first portion coupling feature, where the light source coupling feature is configured to mechanically couple to the light source, and where the first portion coupling feature includes a first number of fastening features. The mounting system of the airfield guard light fixture can also include a second portion mechanically coupled to the first portion. The second portion can include a second portion coupling feature having a second number of fastening features, where the second number of fastening features are mechanically coupled to the first number of fastening features. The second portion can also include a horizontal adjustment feature. The second portion can further include a mounting feature mechanically coupled to the horizontal adjustment feature and configured to mechanically couple to a mounting device. The second portion can also include a guarding device disposed on a top end of the second portion.

These and other aspects, objects, features, and embodiments will be apparent from the following description and the appended claims.

BRIEF DESCRIPTION OF THE DRAWINGS

The drawings illustrate only example embodiments of mounting systems for airfield guard lights and are therefore not to be considered limiting of its scope, as mounting systems for airfield guard lights may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1B:
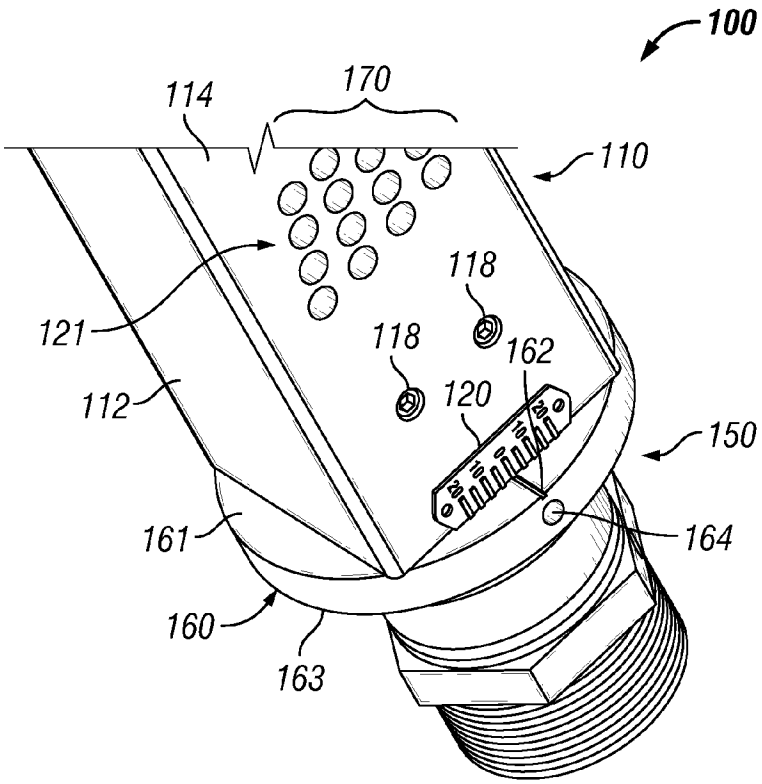
FIGS. 1A-1C show various views of a bottom section of a mounting system in accordance with certain example embodiments.

The example embodiments discussed herein are directed to systems, methods, and devices for mounting systems for airfield guard lights. While example embodiments are directed herein to airfield guard lights, other types of lights, whether for airfield applications or not, can be used with example mounting systems. Example embodiments can be used with lighting fixtures that are located in environments, indoors or outdoors, where temperatures can be above and/or below freezing. Other conditions to which example mounting systems can be exposed can include, but are not limited to, moisture, humidity, dirt, exhaust fumes, vibrations, and noise.

Example embodiments described herein can also be used with other devices (e.g., cameras, signs) that can be mounted, require vertical and/or horizontal adjustment, and are subject to one or more of the conditions described above. In addition, or in the alternative, example embodiments described herein can be used in one or more of a number of industries, including but not limited to transportation (e.g., roadways, railroads), energy (e.g., oil and gas exploration and production), security, chemicals, pipelines, and shipping.

Airfield guard lights (or other types of airport light fixtures) that are used with example mounting systems described herein can be subject to one or more standards, specifications, and/or regulations. For example, an airfield guard light can be subject to Federal Aviation Administration (FAA) specification FAA AC 150/5345-46D. In such a case, the airfield guard light must meet the following mechanical specifications: Wind load of 300 miles per hour, 0° to 20° vertical adjustment in 1° increments, ±20° horizontal adjustment in 5° increments, and maximum 2 inch sway under wind load.

Airport light fixtures using example embodiments described herein allow such airport light fixtures to continue to meet such standards and/or regulations. Similarly, example embodiments used on light fixtures subject to other standards and/or regulations, whether in the airport industry or in another industry, allow such light fixtures to continue to meet such standards and/or regulations. As used herein an airport light fixture can be used on any part of an airport system, including but not limited to a runway, a jetway, and a taxiway.

The example mounting systems (or components thereof) described herein can be made of one or more of a number of suitable materials to allow the mounting systems to meet certain standards and/or regulations while also maintaining durability in light of the one or more conditions under which the mounting system can be exposed. Examples of such materials can include, but are not limited to, aluminum, stainless steel, fiberglass, plastic, and rubber.

Example embodiments described herein can be used with one or more of a number of different types of light source, including but not limited to light-emitting diode (LED) light sources, fluorescent light sources, organic LED light sources, incandescent light sources, and halogen light sources. Therefore, example embodiments of mounting systems for airfield guard lights described herein should not be considered limited to a particular type of light source.

A user may be any person that interacts with a light fixture using example embodiments described herein. Specifically, a user may install, maintain, operate, and/or interface with a light fixture using example mounting systems. Examples of a user may include, but are not limited to, an engineer, an electrician, an instrumentation and controls technician, a mechanic, an operator, a consultant, a contractor, and a manufacturer's representative.

Example embodiments of example mounting systems for airfield guard lights will be described more fully hereinafter with reference to the accompanying drawings, in which example mounting systems for airfield guard lights are shown. Mounting systems may, however, be embodied in many different forms and should not be construed as limited to the example embodiments set forth herein. Rather, these example embodiments are provided so that this disclosure will be thorough and complete, and will fully convey the scope of mounting systems for airfield guard lights to those or ordinary skill in the art. Like, but not necessarily the same, elements (also sometimes called components) in the various figures are denoted by like reference numerals for consistency. Terms such as "first," "second," "distal," "proximal," "top," "bottom," "left," "right," "front," and "back" are used merely to distinguish one component (or part of a component) from another. Such terms are not meant to denote a preference or a particular orientation.

Figure 1A:
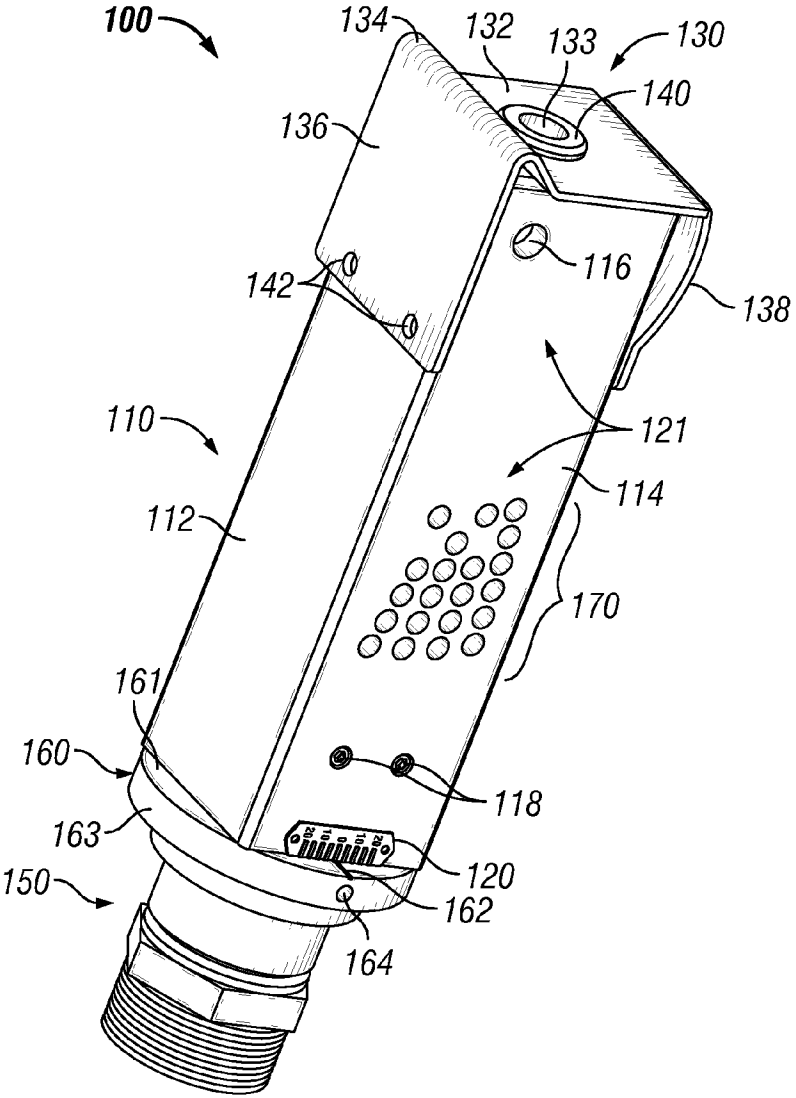
Figure 1C:
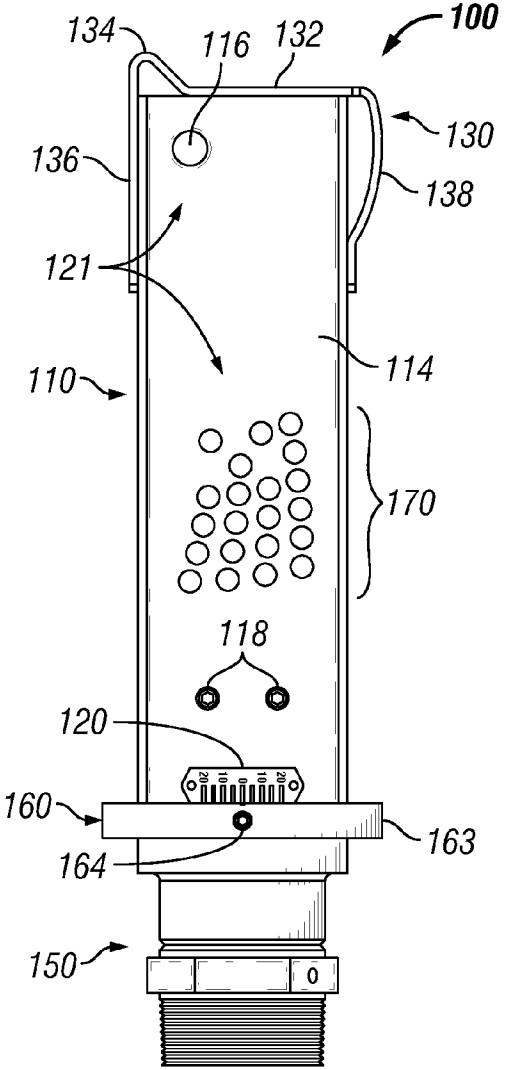

FIGS. 1A-1C show various views of a bottom section 100 of a mounting system in accordance with certain example embodiments. FIG. 1A shows a side perspective view of the bottom section 100. FIG. 1B shows a detailed view of the bottom end of the bottom section 100. FIG. 1C shows a side view of the bottom section 100. In one or more example embodiments, one or more of the components shown in FIGS. 1A-1C may be omitted, repeated, and/or substituted. Accordingly, example embodiments of a mounting system (or portions thereof) should not be considered limited to the specific arrangements of components shown in FIGS. 1A-1C.

Referring now to FIGS. 1A-1C, the bottom section 100 of the mounting structure can include a post 110 (also called a portion 110), a guiding device 130, a mounting feature 150, and a horizontal adjustment feature 160. The post 110 of FIGS. 1A-1C can be hollow inside, defining a cavity that traverses the length of the post 110. The size and shape of the cavity can be sufficient to allow one or more conductors electrically and mechanically coupled to a light source (or other electrical device mechanically coupled to the mounting structure) to pass therethrough.

The post 110 can be made from a single piece (as from a mold or cast), or the post 110 can be made of multiple pieces that are mechanically coupled to each other using one or more of a number of coupling methods. Such coupling methods can include, but are not limited to, welding, compression fittings, clamps, and fastening devices. The post 110 can have one or more of a number of shapes when viewed cross-sectionally. Examples of such shapes can include, but are not limited to, a square (as shown in FIGS. 1A-1C), a rectangle, a circle, an oval, a hexagon, and a triangle. Thus, the post 110 can have one or more of a number of walls (e.g., wall 112, wall 114), corresponding to the cross-sectional shape of the post 110.

One or more walls of the post 110 can have one or more of a number of features disposed thereon. For example, wall 114 (one or both side walls when the cross-sectional shape of the post 110 is square or rectangular) can include one or more vertical adjustment features 121. The vertical adjustment features 121 allow the post 110 and another component (e.g., mounting bracket 200 described below with respect to FIG. 2) of the mounting system to form a vertical angle with respect to each other.

Each vertical adjustment feature 121 can include one or more fastening features. For example, as shown in FIGS. 1A-1C, the vertical adjustment feature 121 of the post 110 can include pivot section 116 and a selection section 170. In such a case, the pivot section 116 can be one or more apertures (in this example, only one aperture) that traverse at least a portion of the wall 114. Such apertures of the pivot section 116 can have a size and be positioned in the wall 114 in such a way as to allow a coupling device (as described below with respect to FIGS. 3 and 5A-5D) to traverse therethrough. The pivot section 116 can be positioned toward the top end of the post 110.

The selection section 170 can be positioned some distance from the pivot section 116 on the wall 114 and include two or more apertures (in this example, 21 apertures) that each traverses at least a portion of the wall 114. Such apertures can also be called vertical angle settings 170. In certain example embodiments, as shown in FIG. 1C, the one or more apertures of the pivot section 116 and the two or more vertical angle settings 170 can be positioned on opposing walls 114 of the post 110 as a mirror image of each other.

In some cases, the fastening features of the vertical adjustment feature 121 can be a feature aside from an aperture. Examples of such other features can include, but are not limited to, a slot, a detent, and a tab. As described below, the fastening features of the vertical adjustment feature 121 can be used to mechanically couple the post 110 to corresponding fastening features of a different portion of the mounting system, creating a vertical position between the post 110 and the other portion of the mounting system.

In addition, or in the alternative, the wall 114 can include a fastening feature in the form of one or more apertures (hidden from view by fastening devices 118) that traverse some or all of the wall 114. Such apertures can be positioned toward the bottom end of the post 110, below the vertical angle settings 170. The apertures can be traversed by one or more fastening devices 118 (e.g., bolts, screws) that can be used to mechanically couple the post 110 to some other component (e.g., mounting feature 150) of the mounting structure.

Another feature that can be included on one or more walls of the post 110 is some or all of a horizontal adjustment feature. The horizontal adjustment feature can allow for horizontal adjustments of the mounting structure. For example, as shown in FIGS. 1A-1C, a horizontal position plate 120 can be positioned at or near the bottom of the post 110 on a wall (e.g., wall 114). The horizontal position plate 120 can display a number of horizontal positions of the mounting structure relative to a reference marker 162 of the horizontal adjustment feature 160. For example, as shown in FIGS. 1A and 1B, the horizontal position plate 120 can display horizontal positions of the mounting structure up to 20° on either side of a center point (designated by the reference marker 162).

The horizontal adjustment feature 160 of the bottom portion 100 of the mounting structure can be a separate component from, or part of, the post 110. If a separate component, the horizontal adjustment feature 160 can be disposed at the bottom end of the post 110 and mechanically coupled to the post 110. The horizontal adjustment feature 160 can include a reference marker 162 disposed on a surface (in this case, the top surface 161). The horizontal adjustment feature 160 can also include one or more securing devices 164 (e.g., set screws) disposed in the same or a different surface (in this case, the outer side 163) relative to the reference marker 162.

The reference marker 162 can be used to orient the horizontal position of the device mounted to the mounting system. For example, if the device is an airfield guard light, the mounting system can be positioned so that the reference marker 162 is substantially perpendicular to the runway/taxiway that is adjacent to where the mounting system is located.

The securing device 164 can be used to lock the horizontal adjustment feature 160, allowing the post 110 (and, more specifically, the rest of the mounting structure) to be locked in one of a number of horizontal positions using the one or more fastening devices 118. The number of horizontal positions can coincide with the range of angles displayed on the horizontal position plate 120. The securing device 164 can be adjusted using a tool (e.g., screwdriver, wrench). Alternatively, the securing device 164 can be adjusted by a user without a tool. Like the post 110, the horizontal adjustment feature 160 can have a cavity that runs along its length. The size and shape of the cavity can be sufficient to allow one or more conductors of the light source to traverse therethrough.

In certain example embodiments, the mounting feature 150 of the bottom portion 100 of the mounting structure can be a separate component from the horizontal adjustment feature 160. The mounting feature 150 can be mechanically coupled to the horizontal adjustment feature 160 in any suitable way (e.g., fixedly, movably) using any suitable coupling means (e.g., mating threads, fastening devices, welding, epoxy, slots).

The guarding device 130 of the bottom portion 100 of the mounting structure can disposed on a top end of the post 110. The guarding device 130 can be fixedly or detachably coupled to the post 110 using one or more of a number of fastening methods, including but not limited to welding, epoxy, fastening devices (using, for example, apertures 142 that traverse the front surface 136 of the guarding device 130), mating threads, and compression fittings. In certain example embodiments, the guarding device is wider than the post 110 and overhangs on (extends beyond) at least one side (e.g., wall 114) of the post 110 when the guarding device 130 is mechanically coupled to the post 110.

The guarding device 130 can have at least one aperture 133 that traverses therethrough. The aperture 133 can have a shape and size that allows one or more conductors electrically and mechanically coupled to a light source (or other electrical device mechanically coupled to the mounting structure) to traverse therethrough. The aperture 133 can be located on one or more of the surfaces of the guarding device 130. Such surfaces can include a front surface 136, a top surface 132 (through which the aperture 133 in F*igure* 1A traverses), and a rear surface 138.

Each surface of the guarding device 130 can be contoured to be substantially the same as, or be different than, the contour of the corresponding surface of the post 110. For example, as shown in FIG. 1A, the front surface 136 and the top surface 132 are substantially flat, substantially matching the flat surface of the wall 112 and the joining of the tops of all the walls of the post 110, respectively. By contrast, the back surface 138 is curved so that only the distal portion of the back surface 138 contacts the back wall of the post 110.

The guarding device 130 can also have one or more of a number of other contours and/or features. For example, as shown in FIG. 1A, the guarding device 130 can include a raised surface 134, which in this case is positioned between the front surface 136 and the top surface 132. The raised surface 134 can be used to help create a gap between the top surface 132 and the bottom of the light source. Such a gap, in conjunction with the aperture 133 (as well as an optional elastomeric device 140 disposed in the aperture 133), can help prevent a pinch point in the conductor disposed in the gap and the aperture 133.

In addition to offering pinch point protection and passage of one or more conductors, the guarding device 130 can serve one or more other purposes, including but not limited to reducing or preventing the incursion of dirt into the cavity of the post 110 and preventing or discouraging animals from entering the cavity of the post 110. A detailed view of the guarding device 130 is shown below with respect to FIG. 4.

Figure 2:
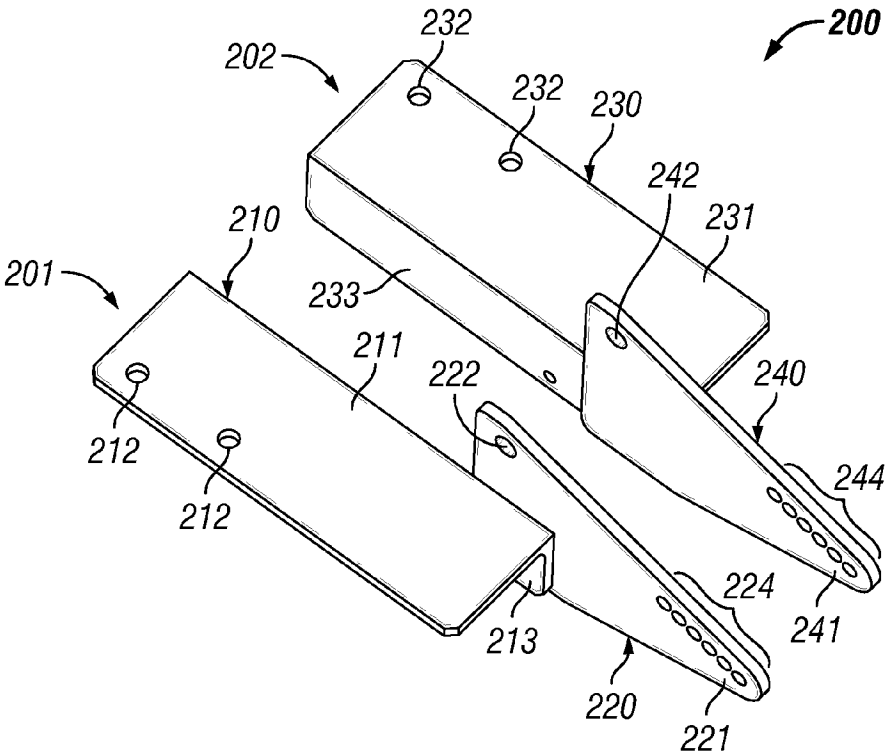
FIG. 2 shows a perspective view of a top section of a mounting system in accordance with certain example embodiments.

FIG. 2 shows a perspective view of a top section 200 of a mounting system in accordance with certain example embodiments. In one or more example embodiments, one or more of the components shown in FIG. 2 may be omitted, repeated, and/or substituted. Accordingly, example embodiments of a mounting system (or portions thereof) should not be considered limited to the specific arrangements of components shown in FIG. 2.

Referring to FIGS. 1A-2, the top section 200 (which can also sometimes be referred to as a "portion") of the mounting system can have one or more pieces. For example, as shown in FIG. 2, the top section 200 can have two pieces (piece 201 and piece 202) that are substantially mirror images of each other. In some cases, piece 201 and piece 202 of the top section 200 can be mechanically coupled to each other to form a single piece. The top section 200 (or pieces thereof, such as piece 201 and piece 202) can be made from a single piece (as from a mold or cast), or the top section 200 (or pieces thereof) can be made of multiple pieces that are mechanically coupled to each other using one or more of a number of coupling methods. Such coupling methods can include, but are not limited to, welding, compression fittings, clamps, and fastening devices.

Piece 201 and piece 202 of the top section 200 can each have one or more of a number of features. For example, as shown in FIG. 2, piece 201 can include a light source coupling feature 210 and a vertical adjustment feature 220. Similarly, piece 202 can include a light source coupling feature 230 and a vertical adjustment feature 240. Alternatively, a piece (e.g., piece 201, piece 202) of the top section 200 can have no features or different features from the other pieces of the top section 200.

In certain example embodiments, the light source coupling feature (e.g., light source coupling feature 210, light source coupling feature 230) is configured to mechanically couple to a light source or some other device. For example, the light source coupling feature 210 of piece 201 of the top section 200 can have a backing member 211 that has one or more apertures 212 that traverse therethrough. In addition to, or instead of, apertures 212, the backing member 211 can have one or more of a number of other coupling features, including but not limited to a slot, a notch, a tab, and a clamp.

Similarly, the light source coupling feature 230 of piece 202 of the top section 200 can have a backing member 231 that has one or more apertures 232 that traverse therethrough. The size and position of the apertures 212 in the backing member 211 and the apertures 232 in the backing member 231 can coincide with the size and position of apertures (or other coupling features) of the light source (or other device) that mechanically couples to the top section 200. Similarly, the size and shape of the backing member 211 and backing member 231 can be appropriate to allow the top section 200 to mechanically couple to the light source (or other device).

In certain example embodiments, the backing member (e.g., backing member 211, backing member 231) can have an extension that protrudes therefrom. For example, as shown in FIG. 2, the backing member 211 of piece 201 can have an extension 213 positioned along one side (in this case, the elongated side of the backing member 211 opposite from where the apertures 212 are positioned) of the backing member 211. The extension 213 can extend at any angle and direction from the backing member 211. For example, as shown in FIG. 2, the extension 213 can extend approximately 90° downward from the backing member 211.

Similarly, the backing member 231 of piece 202 can have an extension 233 disposed along the inner side of the backing member 231 and directed downward by approximately 90° . The extension (e.g., extension 213, extension 233) and the corresponding backing member can be a single piece or separate pieces that are mechanically coupled to each other using one or more of a number of coupling methods, including but not limited to welding, fastening devices, and compression fittings. The extension can have one or more of a number of features (e.g., apertures) to mechanically couple the corresponding piece (e.g., piece 201, piece 202) to the light source (or other device) and/or another component of the mounting system.

In certain example embodiments, the vertical adjustment feature (e.g., vertical adjustment feature 220, vertical adjustment feature 240) has a number of fastening features and is configured to mechanically couple the top section 200 to the post 110. More specifically, the fastening features (described below) of the vertical adjustment features of the top section 200 mechanically couple to the vertical adjustment features 121 (also called fastening features) of the post 110.

For example, as shown in FIG. 2, the vertical adjustment feature 220 of piece 201 of the top section 200 can include two fastening features: Pivot section 222 and a selection section 224. In such a case, the pivot section 222 of the piece 201 can be one or more apertures (in this example, only one aperture) that traverse at least a portion of the vertical adjustment feature 220. Such apertures of the pivot section 222 can have a size and be positioned in the vertical adjustment feature 220 in such a way as to allow a coupling device (as described below with respect to FIGS. 3 and 5A-5D) to traverse therethrough. The pivot section 222 can be positioned toward the top end of the vertical adjustment feature 220.

The vertical selection section 224 of the piece 201 can be positioned some distance from the pivot section 222 on the vertical adjustment feature 220 and include two or more apertures (in this example, 6 apertures) that each traverses at least a portion of the body 221 of the vertical adjustment feature 220. Such apertures can also be called vertical angle settings 224. Similarly, the vertical adjustment feature 240 of piece 202 can include a pivot section 242 and a vertical selection section 244, disposed in the body 241 of the vertical adjustment feature 240, that are substantially similar to the pivot section 222 and the vertical selection section 224 of piece 201.

In some cases, the fastening features (e.g., the pivot section 222, the vertical selection section 224) of the vertical adjustment feature 220 and/or the fastening features (e.g., the pivot section 242, the vertical selection section 244) of the vertical adjustment feature 240 can be a feature aside from an aperture. Examples of such other features can include, but are not limited to, a slot, a detent, and a tab.

As described above, the fastening features of the vertical adjustment feature 220 and the fastening features of the vertical adjustment feature 240 can be used to mechanically couple the top section 200 to corresponding fastening features of the vertical adjustment feature 121 of the post 110 of the mounting system, creating a vertical position between the post 110 and the top section 200 of the mounting system. The size and shape of each vertical adjustment feature, as well as the size and positioning of the pivot section and the vertical selection section, can correspond to the size and shape of the vertical adjustment features 121 of the post 110.

Figure 3:
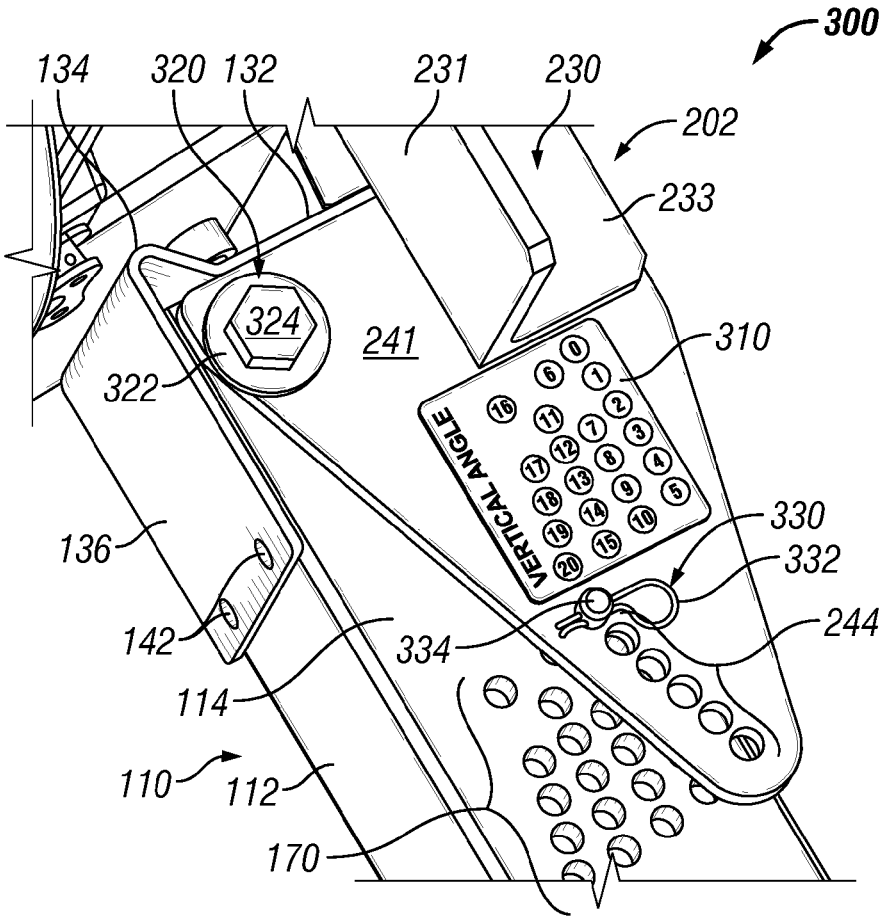
FIG. 3 shows a perspective view of the vertical adjustment feature using the sections of the mounting system shown in FIGS. 1 and 2 in accordance with certain example embodiments.

FIG. 3 shows a perspective view of the vertical adjustment feature 300 using the bottom section 100 and the top section 200 of the mounting system shown in FIGS. 1 and 2, respectively, in accordance with certain example embodiments. Labels not shown in FIG. 3 but referred to with respect to FIG. 3 can be incorporated by reference from FIGS. 1A-2. Similarly, a description of a label shown in FIG. 3 but not described with respect to FIG. 3 can use the description from FIGS. 1A-2.

In this case, the post 110 fits inside of the vertical adjustment feature 240 of piece 202 of the top portion 200. Specifically, the vertical adjustment feature 240 is disposed substantially flush with the wall 114 of the post 110. While hidden from view, on the opposite side of the post 110, the vertical adjustment feature 220 of piece 201 can similarly be disposed substantially flush with the wall opposite wall 114 of the post 110.

The vertical adjustment feature 240 can be mechanically coupled to the post 110 in one or more locations. For example, in this case, the vertical adjustment feature 240 is mechanically coupled to the post 110 in two locations. The first location in which the vertical adjustment feature 240 is mechanically coupled to the post 110 in this example is where the pivot section 242 (hidden from view) of the vertical adjustment feature 240 aligns with the pivot section 116 (also hidden from view) of the post 110. In such a case, a fastening device 320 can be used to traverse through the apertures of the pivot section 242 and the pivot section 116 (and, in some cases, also the pivot section 222 of the vertical adjustment feature 220).

In certain example embodiments, the fastening device 320 includes a bolt 324, at least one washer 322, and a nut (hidden from view). The fastening device 320 can have one or more of a number of other configurations. For example, the fastening device 320 can be a rivet. As another example, the fastening device 320 can be a pin with holes at each end that receive a cotter pin that traverses the holes, where the holes are positioned outside the vertical adjustment feature 220 and the vertical adjustment feature 240.

The fastening device 320 can be appropriate to the configuration of the pivot section 242, the pivot section 222, and the pivot section 116. In some cases, the fastening device can be omitted if the pivot section 242 and the pivot section 116 couple to each other and/or the pivot section 222 and the pivot section 116 couple to each other without an additional component. In any case, when the pivot section 242 and the pivot section 116 (and in some cases, the pivot section 222 and the pivot section 116) are coupled to each other, the top section 200 can rotate about the fastening device 320 with respect to the post 110 while the fastening device 320 is fixedly coupled to the pivot section 242, the pivot section 222, and the pivot section 116.

As another example of a location in which the vertical adjustment feature 240 can be mechanically coupled to the post 110 (the second location described above), a portion of the vertical selection section 244 of the vertical adjustment feature 240 and the vertical selection section 224 (hidden from view) of the vertical adjustment feature 220 can be mechanically coupled to the vertical selection section 170 of the post 110. In such a case, a fastening device 330 can be used to traverse through the apertures of the vertical selection section 244 and the vertical selection section 170 (and, in some cases, also the vertical selection section 224 of the vertical adjustment feature 220).

In certain example embodiments, the fastening device 330 includes a pin 334 with a hole at one or both ends and at least one cotter pin 332. If the pin has a hole at only one end, then the other end can have one or more of a number of features to help keep the pin 334 in place. Examples of such features can include, but are not limited to, a flattened end that has a larger perimeter than the rest of the pin 334. The fastening device 330 can be removed and/or inserted by a user without the use of a tool (e.g., screwdriver, wrench). In other words, a user can use his or her hands to remove the cotter pin 332, remove the pin 334 from a particular aperture of the vertical selection section 244, the vertical selection section 224, and the vertical selection section 170, insert the pin 334 into a different particular aperture of the vertical selection section 244, the vertical selection section 224, and/or the vertical selection section 170, and insert the cotter pin 332 into a secure position relative to the pin 334.

In certain example embodiments, the one or more cotter pins 332 can be tethered to the pin 332 and/or some other component (e.g., the body 241 of the vertical adjustment feature 240) of the mounting system. In such a case, the cotter pin 332 can be tethered using a metal thread, a chain, or some other tether capable of withstanding the elements to which the mounting system can be exposed. The tether can be used to help prevent losing the cotter pin 332 when the cotter pin 332 is removed from a secure position relative to the pin 334.

Aside from a pin 334 and cotter pin 332, other fastening devices 330 can be used to mechanically couple a portion of the vertical selection section 244 of the vertical adjustment feature 240 and the vertical selection section 224 of the vertical adjustment feature 220 can be mechanically coupled to the vertical selection section 170 of the post 110. For example, the fastening device 330 can be a bolt, at least one washer, and a nut. The fastening device 330 can have one or more of a number of other configurations, all of which allow the fastening device 330 to be removed and reinserted, allowing the vertical position of the top section 200 to change relative to the post 110.

The fastening device 330 can be appropriate to the configuration of the vertical selection section 244, the vertical selection section 224, and the vertical selection section 170. In some cases, the fastening device can be omitted if the vertical selection section 244 and the vertical selection section 170 couple to each other and/or the vertical selection section 224 and the vertical selection section 170 couple to each other without an additional component. In any case, when the vertical selection section 244 and the vertical selection section 170 (and in some cases, the vertical selection section 224 and the vertical selection section 170) are coupled to each other, the top section 200 is held in a particular vertical position relative to the post 110 because the fastening device 320 is fixedly coupled to the pivot section 242, the pivot section 222, and the pivot section 116.

Using the pivot section 242 and the vertical selection section 244 of the vertical adjustment feature 240, the pivot section 222 and the vertical selection section 224 of the vertical adjustment feature 220, and the pivot section 116 and the vertical selection section 170 of the post 110, the particular orientation of the top section 200 relative to the post 110 can be called a vertical position. In certain example embodiments, a number of vertical positions can be chosen by a user. For example, in this case, there are a total of 21 vertical positions. In other words, there are 21 distinct positions that the top section 200 can have relative to the post 110.

When the vertical adjustment feature 240 and/or the vertical adjustment feature 220 are mechanically coupled to the post 110 using the respective pivot sections, the width of the top surface 132 of the guarding device 130 can be at least as great as the width of the post 110 plus at least a portion of the thickness of the vertical adjustment feature 240 and the vertical adjustment feature 220. In such a case, the movement of the vertical adjustment feature 240 and the vertical adjustment feature 220 (and, thus, the top portion 220) can be limited in one direction by the top surface 132 of the guarding device 130.

Similarly, when the vertical adjustment feature 240 and/or the vertical adjustment feature 220 are mechanically coupled to the post 110 using the respective pivot sections, the width of the front surface 136 of the guarding device 130 can be at least as great as the width of the post 110 plus at least a portion of the thickness of the vertical adjustment feature 240 and the vertical adjustment feature 220. In such a case, the movement of the vertical adjustment feature 240 and the vertical adjustment feature 220 (and, thus, the top portion 220) can be limited in another direction (e.g., opposite the direction described in the preceding paragraph) by the front surface 136 of the guarding device 130.

Thus, the rotational movement of the top section 200 about the fastening device 320 relative to the post 110 can be bounded. In this example, the guarding device 130 limits the range of rotational motion of the top section 200 about the fastening device 320 relative to the post 110 to between -1° and 21°, inclusive. In other words, the guarding device 130 can prevent the vertical position of the top section 200 relative to the post 110 from exceeding the range between -1° and 21°, inclusive. The angle of the vertical position can be measured from the acute angle formed between the top section 200 (e.g., the plane formed by the backing member 231 of the light source coupling feature 230) and the post 110 (e.g., the plane formed by wall 112).

The number and orientation of apertures in the vertical selection section 244 relative to the number and orientation of apertures in the vertical selection section 170 can create a number of discrete vertical positions. For example, in this example, there are a total of 21 different discrete vertical positions, where each vertical position is in one degree increments from an adjacent vertical position between 0° and 20°, inclusive. Other ranges of motion and/or other incremental differences between vertical positions can be achieved in certain example embodiments.

In certain example embodiments, a vertical position plate 310 can be used to display one or more vertical positions. For example, as shown in FIG. 3, the vertical position plate 310 shows how 21 different vertical positions (vertical angles) can be achieved. In this case, the vertical positions shown on the vertical position plate 310 correspond to the orientation of the vertical angle settings 170 disposed in the post 110. To achieve a particular vertical position, only one of the vertical angle settings 244 of the vertical adjustment feature 240 can be properly aligned.

For example, in this case, the fastening device 330 traverses the top-most aperture of the vertical angle settings 244 and the upper-right-most aperture of the vertical angle settings 170. The vertical position plate 310 shows that the vertical position of the upper-right-most aperture of the vertical angle settings 170 is 0°, and so the vertical position shown in FIG. 3 is 0°. In other words, to achieve a vertical position of 0°, the fastening device 330 must traverse the upper-right-most aperture of the vertical angle settings 170 (based on the vertical position plate 310), and the only aperture of the vertical angle settings 244 that can align with the upper-right-most aperture of the vertical angle settings 170 is the top-most aperture.

The vertical position plate 310 can display any other configuration of vertical positions in any suitable manner. For example, if there are 6 apertures for the vertical angle settings 170 and 21 apertures for the vertical angle settings 244, then the display of the vertical positions on the vertical position plate 310 can correspond to the apertures of the vertical angle settings 244.

The vertical position plate 310 can be affixed to the body 241 of the vertical adjustment feature 240, at any location (e.g., adjacent to the vertical angle settings 244) on the body 241. Alternatively, the vertical position plate 310 can be affixed to some other component (e.g., the post 110) of the mounting system that is visible to a user. The vertical position plate 310 can be affixed to a component of the mounting system using one or more of a number of fastening methods, including but not limited to epoxy and fastening devices.

As discussed above, the mounting system described herein can be used to mount a device (e.g., a light source) in compliance with one or more standards and/or regulations. For example, if the device is a L-804 airfield guard light, when the device is mechanically coupled to the light source coupling feature 210 and the light source coupling feature 230 of the top section 200, the assembled system can comply with FAA standard AC 150/5345-46D.

Figure 4:
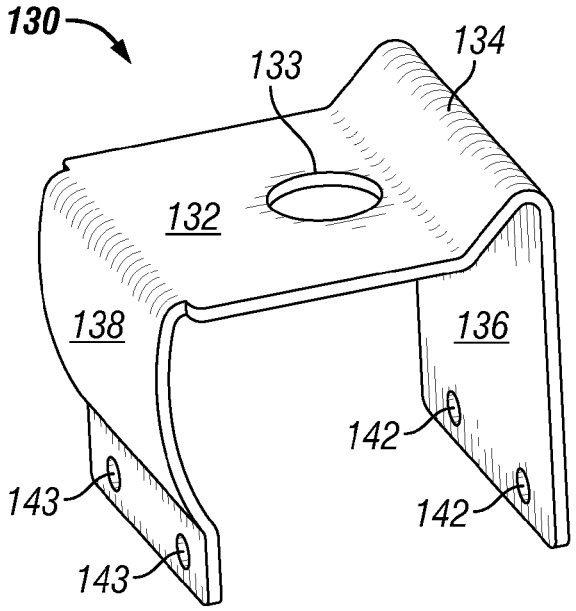
FIG. 4 shows a perspective view of a guarding device of the mounting system shown in FIGS. 1A, 1C, and 3 in accordance with certain example embodiments.

FIG. 4 shows a perspective view of the guarding device 130 of the mounting system shown in FIGS. 1A, 1C, and 3 in accordance with certain example embodiments. In one or more example embodiments, one or more of the components shown in FIG. 4 may be omitted, repeated, and/or substituted. Accordingly, example embodiments of a guarding device should not be considered limited to the specific arrangements of components shown in FIG. 4. Further, labels not shown in FIG. 4 but referred to with respect to FIG. 4 can be incorporated by reference from FIGS. 1A-3. Similarly, a description of a label shown in FIG. 4 but not described with respect to FIG. 4 can use the description from FIGS. 1A-3.

Referring to FIGS. 1A-4, the width of the top surface 132 and the front surface 136 can be substantially equal. In addition, the width of the back surface 138 can be less than the width of the top surface 132 and the front surface 136. In such a case, the width of the back surface 138 can be the same as, or less than, the width of the post 110, allowing the body 241 of the vertical adjustment feature 240 to rotate beyond the back surface 138 of the guarding device 130. In addition to, or in the alternative of, the apertures 142 that traverse the front surface 136 described above, one or more other surfaces (e.g., the back surface 138) can have one or more apertures (e.g., apertures 143) that traverse therethrough. Such apertures can be used to receive one or more fastening devices (e.g., bolts, screws) to mechanically couple the guarding device 130 to the post 110.

Figure 5B:
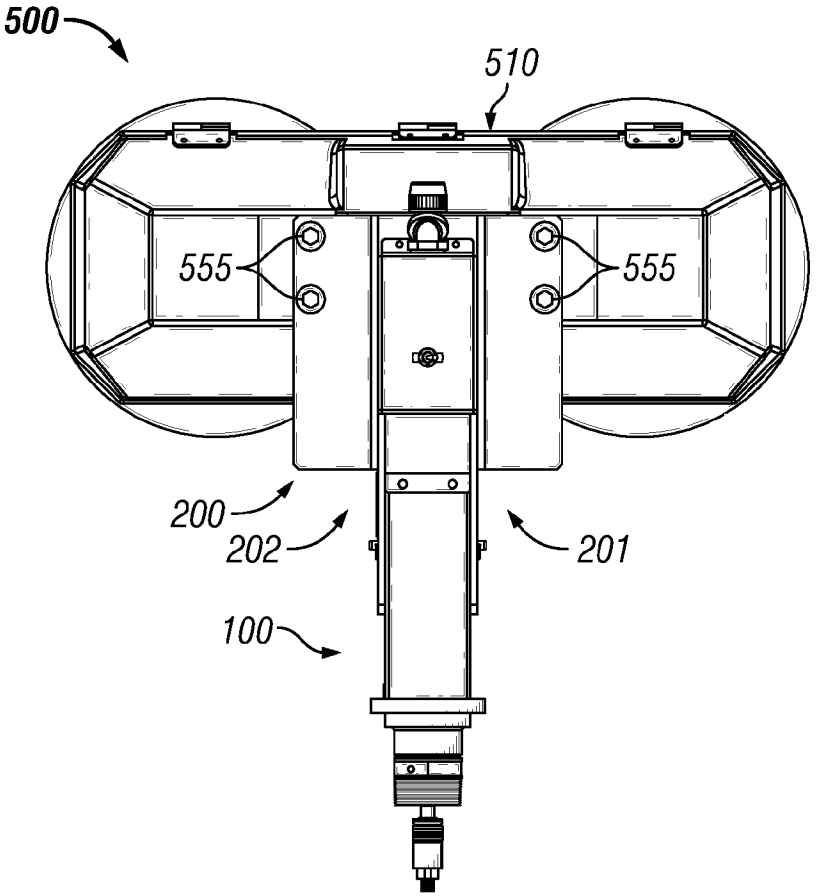
FIGS. 5A-5D show various views of a light fixture that includes an example mounting system in accordance with certain example embodiments.
Figure 5A:
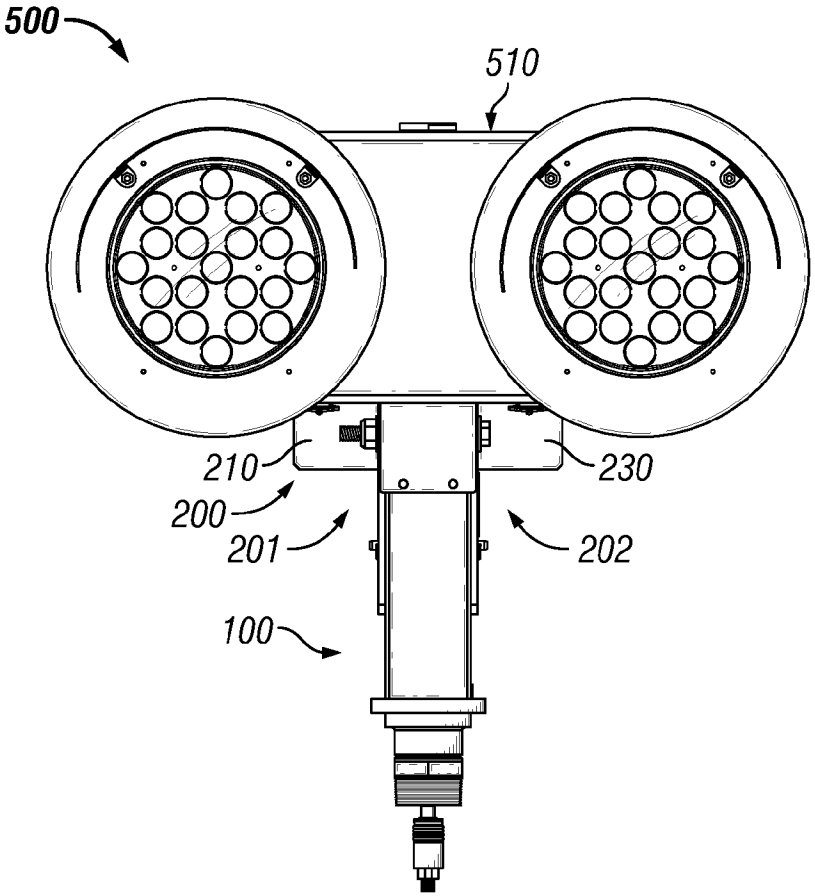
Figure 5D:
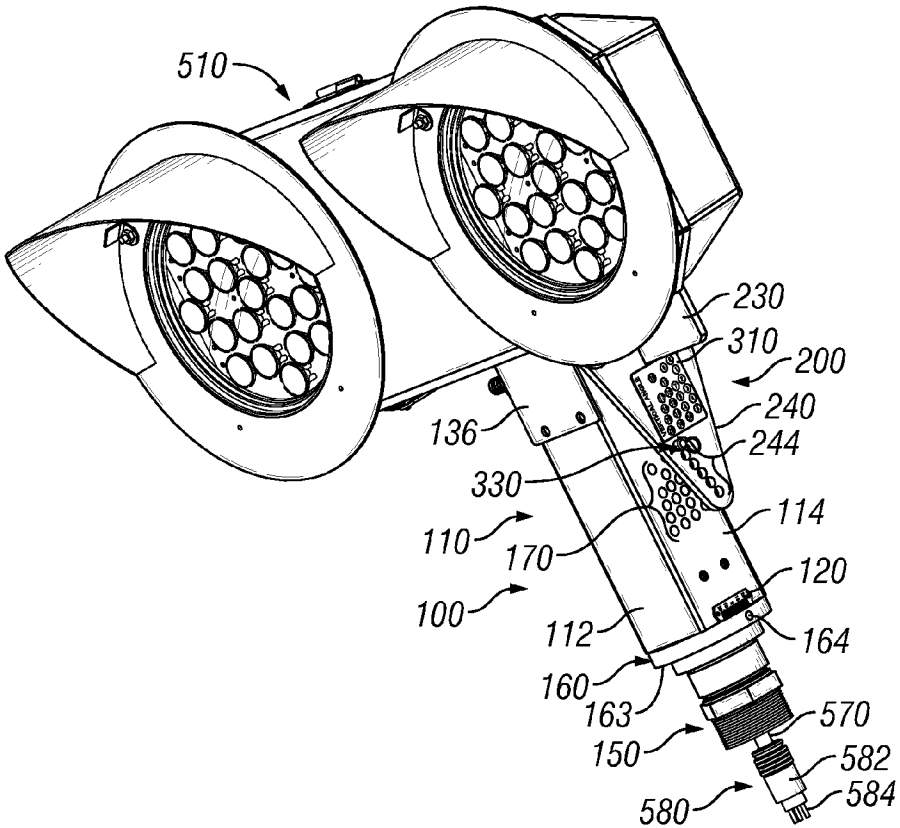
Figure 5C:
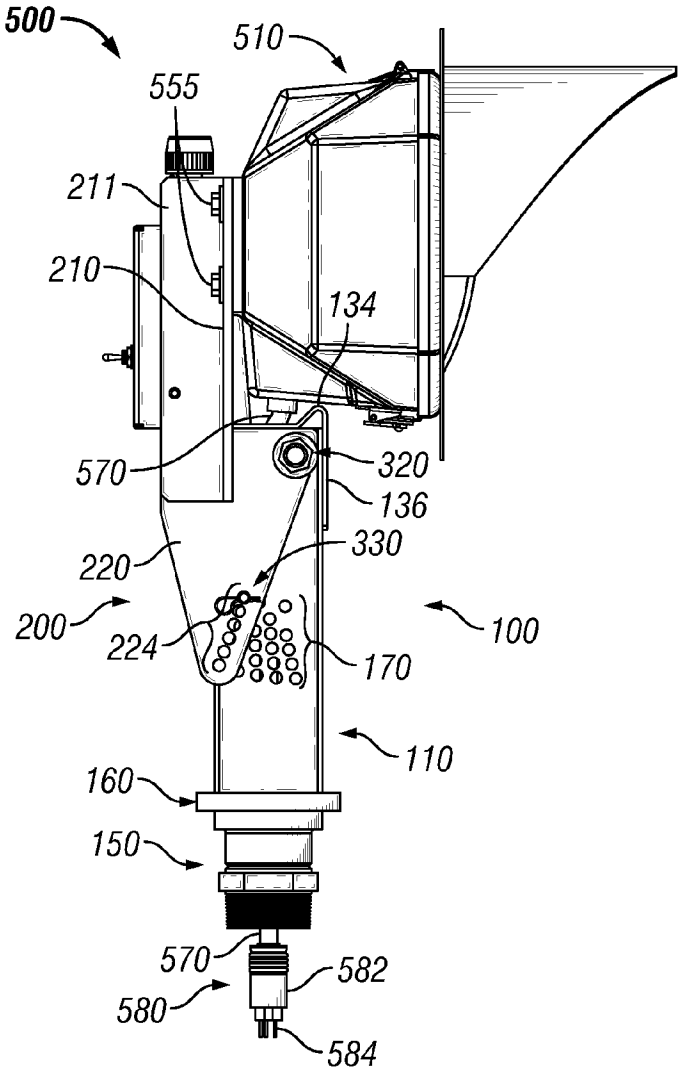

FIGS. 5A-5D show various views of a light fixture 500 that includes an example mounting system in accordance with certain example embodiments. Specifically, FIG. 5A shows a front view of the light fixture 500. FIG. 5B shows a rear view of the light fixture. FIG. 5C shows a side view of the light fixture 500. FIG. 5D shows a front perspective view of the light fixture 500.

In one or more example embodiments, one or more of the components shown in FIGS. 5A-5D may be omitted, repeated, and/or substituted. Accordingly, example embodiments of a lighting fixture using an example mounting system should not be considered limited to the specific arrangements of components shown in FIGS. 5A-5D. Further, labels not shown in FIGS. 5A-5D but referred to with respect to FIGS. 5A-5D can be incorporated by reference from FIGS. 1A-4. Similarly, a description of a label shown in FIGS. 5A-5D but not described with respect to FIGS. 5A-5D can use the description from FIGS. 1A-4.

Referring to FIGS. 1A-5D, the light fixture 500 of FIGS. 5A-5D can include a light source 510 mechanically coupled to the mounting system. Specifically, the light source 510 is mechanically coupled to the light source coupling feature 210 of piece 201 and the light source coupling feature 230 of piece 202 of the top section 200. Fastening devices 555 can be used to mechanically couple the top section 200 to the light source 510. For example, in this case, the fastening devices 555 are bolts that traverse the apertures 212 in the backing member 211 and the apertures 232 in the backing member 231.

The light source 510 can be any light source. In this example, the light source is a model L-804 airfield guard light. The vertical position of the top section 200 relative to the post 110 is 0° . A conductor 570 (e.g., a power cord) that originates in the light source 510 (is coupled to the light source 510) exits through the bottom of the light source 510 and traverses and is disposed within the aperture 133 in the guarding device 130 disposed on the top end of the post 110. The conductor 570 also traverses and is disposed within the cavities along the length of the post 110, the horizontal adjustment feature 160, and the mounting feature 150. The bottom end of the conductor 570 is electrically and mechanically coupled to a connector 580. The connector 580 can have a connector body 582 and one or more connector pins 584.

When the light fixture 500 is mounted, using the mounting feature 150, to corresponding mounting structure, a user can adjust the vertical position of the light source 510 between 0° and 20° degrees, inclusive, in one degree increments without the use of tools. Specifically, the user can manually, without the use of tools, remove the fastening device 330, move the light source 510 to a different vertical position by rotating the light source 510 (and, thus, the top section 200), and insert and secure the fastening device 330 into the appropriate apertures in the vertical angle settings 224, vertical angle settings 244, and the vertical angle settings 170. This will cause the light generated by the light source 510 to be directed within a range of approximately horizontally away from the light source and approximately 20° above horizontal, respectively.

Further, a user can adjust, with or without tools, the horizontal position of the light source 510. Specifically, the user can loosen the one or more securing devices 164 of the horizontal adjustment feature 160 and align reference marker 162 substantially perpendicular to the taxiway/runway and tighten the securing device 164. Once the fastening devices 118 are sufficiently loosened, the user can rotate the light source 510 along with the mounting system to a different horizontal position, using the horizontal position plate 120 relative to the reference marker 162 as a guide. With the light source 510 in the new horizontal position, the one or more fastening devices 118 can be tightened by the user to maintain the light source 510 in that new horizontal position.

In one or more example embodiments, example mounting systems described herein can be used to mount a device, such as a light source. The example mounting system allows a user to make vertical and horizontal adjustments, where at least the vertical adjustments can easily be made without the use of a tool. The mounting systems described herein, when mounted with particular devices, comply with one or more of a number of standards and/or regulations. For example, if the device is a L-804 airfield guard light, then the guard light, when mechanically coupled to the example mounting system, complies with FAA standard AC 150/5345-46D.

Accordingly, many modifications and other embodiments set forth herein will come to mind to one skilled in the art to which mounting systems pertain having the benefit of the teachings presented in the foregoing descriptions and the associated drawings. Therefore, it is to be understood that mounting systems are not to be limited to the specific embodiments disclosed and that modifications and other embodiments are intended to be included within the scope of this application. Although specific terms are employed herein, they are used in a generic and descriptive sense only and not for purposes of limitation.

what is claimed is:

1. A mounting system for a light source, the mounting system comprising:

a first portion comprising a light source coupling feature and a first vertical adjustment feature, wherein the light source coupling feature is configured to mechanically couple to the light source, and wherein the first vertical adjustment feature comprises a first plurality of fastening features;

a second portion mechanically coupled to the first portion, wherein the second portion comprises a second vertical adjustment feature comprising a second plurality of fastening features, wherein the second plurality of fastening features are mechanically coupled to the first plurality of fastening features;

a horizontal adjustment feature disposed at a bottom end of the second portion and mechanically coupled to the second portion;

a mounting feature mechanically coupled to the horizontal adjustment feature and configured to mechanically couple to a mounting device; and a guarding device disposed on a top end of the second portion.

2. The mounting system of claim 1, wherein the horizontal adjustment feature comprises at least one securing device to lock the second portion in a horizontal position of a plurality of horizontal positions.

3. The mounting system of claim 2, wherein the plurality of horizontal positions is up to 20° on either side of a center point.

4. The mounting system of claim 1, wherein the guarding device is wider than the top end of the second portion and overhangs on at least one side of the top end of the second portion when the guarding device is mechanically coupled to the second portion.

5. The mounting system of claim 4, wherein mechanically coupling the first plurality of fastening features of the first portion to the second plurality of fastening features of the second portion places the first portion in a first vertical position of a plurality of vertical positions relative to the second portion, wherein the first vertical position is among a plurality of vertical positions.

6. The mounting system of claim 5, wherein the first vertical position is within a range between 0° and 20°, inclusive, and is measured from an acute angle formed between the first portion and the second portion, wherein the guarding device prevents the plurality of vertical positions from exceeding the range between -1° and 21°, inclusive.

7. The mounting system of claim 5, wherein the first plurality of fastening features of the first portion comprises a first section and a second section, wherein the second section comprises a plurality of first vertical angle settings.

8. The mounting system of claim 7, wherein the second plurality of fastening features of the second portion comprises a third section and a fourth section, wherein the fourth section comprises a plurality of second vertical angle settings, wherein the first section and the third section are rotatably coupled to each other by a fastening device fixedly coupled to the first section and the third section.

9. The mounting system of claim 8, wherein mechanically coupling a first vertical angle setting of the plurality of first vertical angle settings and a second vertical angle setting of the plurality of second vertical angle settings places the first portion in the first vertical position relative to the second portion.

10. The mounting system of claim 9, further comprising:

a fastening device removably coupled to the first vertical angle setting of the plurality of first vertical angle settings and the second vertical angle setting of the plurality of second vertical angle settings, wherein the fastening device can be removed and inserted by a user without use of a tool.

11. The mounting system of claim 8, wherein mechanically coupling another first vertical angle setting of the plurality of first vertical angle settings and another second vertical angle setting of the plurality of second vertical angle settings places the first portion in a second vertical position of the plurality of vertical positions relative to the second portion, wherein the second vertical position is between 0° and 20°, inclusive, from a plane normal to the second portion.

12. The mounting system of claim 8, wherein each vertical position of the plurality of vertical positions is in one degree increments from an adjacent vertical position.

13. The mounting system of claim 12, wherein the plurality of first vertical angle settings comprises six first vertical angle settings, and wherein the plurality of second vertical angle settings comprises 21 second vertical angle settings.

14. The mounting system of claim 12, further comprising:

a vertical position plate affixed to the first portion adjacent to the second section, wherein the vertical position plate displays a vertical position of the plurality of vertical positions for each of the second vertical angle settings.

15. The mounting system of claim 1, wherein the first portion further comprises two pieces that are substantially mirror images of each other, wherein each piece comprises the light source coupling feature and the first portion coupling feature.

16. The mounting system of claim 1, wherein the guarding device has an aperture through which a conductor of the light source traverses, wherein the conductor further traverses a cavity within the second portion along a length of the second portion.

17. The mounting system of claim 1, wherein the first portion and the second portion, when coupled to each other and the light source, comply with Federal Aviation Administration standard AC 150/5345-46D, wherein the light source is an airfield guard light.

18. An airfield guard light fixture, comprising:

a light source; and a mounting system mechanically coupled to the light source, wherein the mounting system comprises:

a first portion comprising a light source coupling feature and a first portion coupling feature, wherein the light source coupling feature is configured to mechanically couple to the light source, and wherein the first portion coupling feature comprises a first plurality of fastening features; and a second portion mechanically coupled to the first portion, wherein the second portion comprises:

a second portion coupling feature comprising a second plurality of fastening features, wherein the second plurality of fastening features are mechanically coupled to the first plurality of fastening features;

a horizontal adjustment feature;

a mounting feature mechanically coupled to the horizontal adjustment feature and configured to mechanically couple to a mounting device; and a guarding device disposed on a top end of the second portion.

19. The airfield guard light fixture of claim 18, wherein the light source is a L-804 airfield guard light.

20. The airfield guard light fixture of claim 18, wherein the second portion further comprises a cavity that traverses therethrough, wherein the cavity has disposed therein a conductor that couples to the light source.

* * * * *